United States Patent [19]

Herfeld

[11] Patent Number: 4,671,666

[45] Date of Patent: Jun. 9, 1987

[54] MIXING DEVICE

[76] Inventor: Friedrich W. Herfeld, Wall 1, 5982 Neuenrade, Fed. Rep. of Germany

[21] Appl. No.: 754,430

[22] Filed: Jul. 12, 1985

[30] Foreign Application Priority Data

Jul. 16, 1984 [DE] Fed. Rep. of Germany ..... 3426159

[51] Int. Cl.[4] ..... B01F 7/02

[52] U.S. Cl. ..... 366/197; 366/66; 366/222; 366/224; 366/246; 366/285; 366/293

[58] Field of Search ..... 366/64–67, 366/197, 199, 200, 201, 207, 208, 242–251, 279, 222, 285, 224, 309–313, 325, 326, 347, 292, 601, 293

[56] References Cited

U.S. PATENT DOCUMENTS

| | | | |
|---|---|---|---|
| 1,714,588 | 5/1929 | Bushnell | 366/67 |
| 1,982,531 | 11/1934 | Nash | 366/245 |
| 2,719,031 | 9/1955 | Morgan | 366/245 |
| 2,861,787 | 11/1958 | Csanyi | 366/66 |
| 3,211,436 | 10/1965 | Butterfield | 366/67 |
| 4,432,650 | 2/1984 | Langen et al. | 366/200 X |

*Primary Examiner*—Timothy F. Simone
*Attorney, Agent, or Firm*—Learman & McCulloch

[57] ABSTRACT

The invention relates to a mixer having a mixing vessel composed of two vessel parts and which can be pivoted through 180° about a horizontal axis. The stirrer shaft is coaxial with the axis about which the vessel is pivoted and the drive motor of the stirrer is stationary. Such a mixer is distinguished by a simple and light transport facility for the product to be mixed, the use of the same mixer for different products, simple cleaning of the second vessel part, and a good mixing effect.

8 Claims, 4 Drawing Figures

MIXING DEVICE

The invention relates to a mixer composed of two separable parts which together form a mixing vessel.

BACKGROUND OF THE INVENTION

A mixing device of the general class to which the invention relates is disclosed in German patent Specification No. 21 10 047. In this known mixing device the drive motor of the stirrer is mounted on the movable vessel part, and the stirrer shaft assumes a vertical position in the mixing position.

The object of the invention is to improve the known mixing device so that the design and construction are simplified and at the same time the mixing effect is improved.

SUMMARY OF THE INVENTION

A mixer according to the invention includes a stirrer drive motor which, rather than being supported by the movable vessel part, is mounted independently thereby enabling the pivot mounting of the movable vessel part and the pivot drive to be of significantly lighter construction.

The stirrer shaft according to the invention occupies a horizontal position in the operating condition of the mixer and this arrangement leads to a substantial intensification and improvement of the mixing effect and thus to a shortening of the necessary mixing times.

THE DRAWINGS

A preferred embodiment of the invention is disclosed in the following description and the accompanying drawings; wherein.

DETAILED DESCRIPTION

Figure 1:
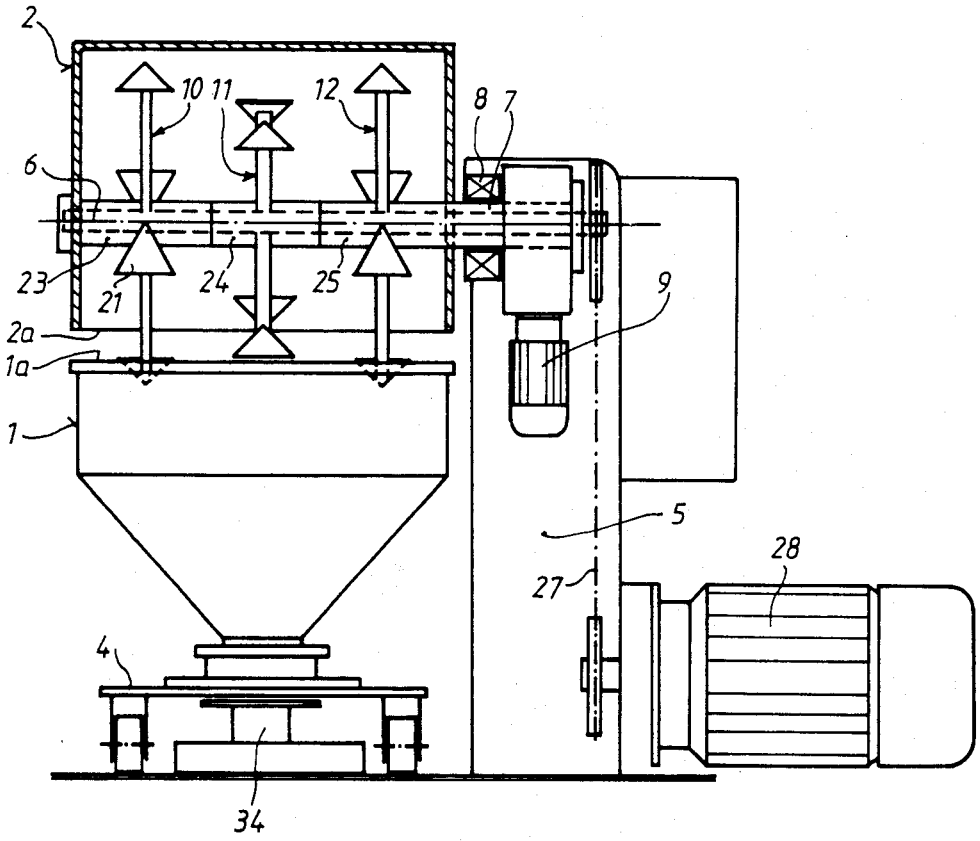
FIG. 1 is a partially cutaway side view of a mixing device according to the invention.
Figure 2:
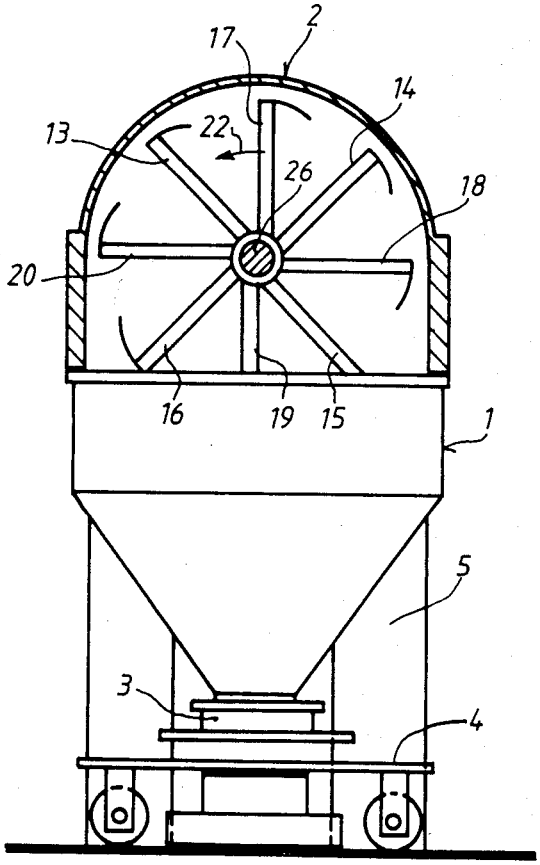
FIG. 2 is a partially cutaway view rotated 90° relative to FIG. 1.

The mixing device illustrated schematically in FIGS. 1 and 2 comprises a mixing vessel having two cup-like vessel parts 1 and 2. The first vessel part 1 is provided with a base outlet 3 and is so constructed so as to be transportable by means of a wheeled wagon 4, for example.

The second vessel part 2 is mounted on a stationary support 5 so as to be pivotable about a horizontal axis 6. For this purpose the second vessel part 2 is supported by a hollow shaft 7 which is mounted in bearings 8 in the support 5 and connected to a rotary drive motor 9 which is indicated schematically.

In the second vessel part 2 is mounted a stirrer which, in the illustrated embodiment, comprises three groups 10, 11, 12 of four mixing blades each evenly distributed on the periphery. For example, as shown in FIG. 2 the mixing blades of the groups 10 and 12 are designated by 13, 14, 15 and 16 and the mixing blades of the group 11 by 17, 18, 19 and 20. In the illustrated embodiment the mixing blades 13 to 20 have on their ends triangular mixing plates 21 which are arranged so that the apex of the triangular mixing plate points in the direction of rotation (arrow 22) in the mixing operation.

The hubs 23, 24 and 25 of the three groups 10, 11 and 12 of mixing blades are mounted on a stirrer shaft 26 which extends through the hollow shaft 7 and is connected via a chain drive 27 to a stationary drive motor 28.

Figure 3:
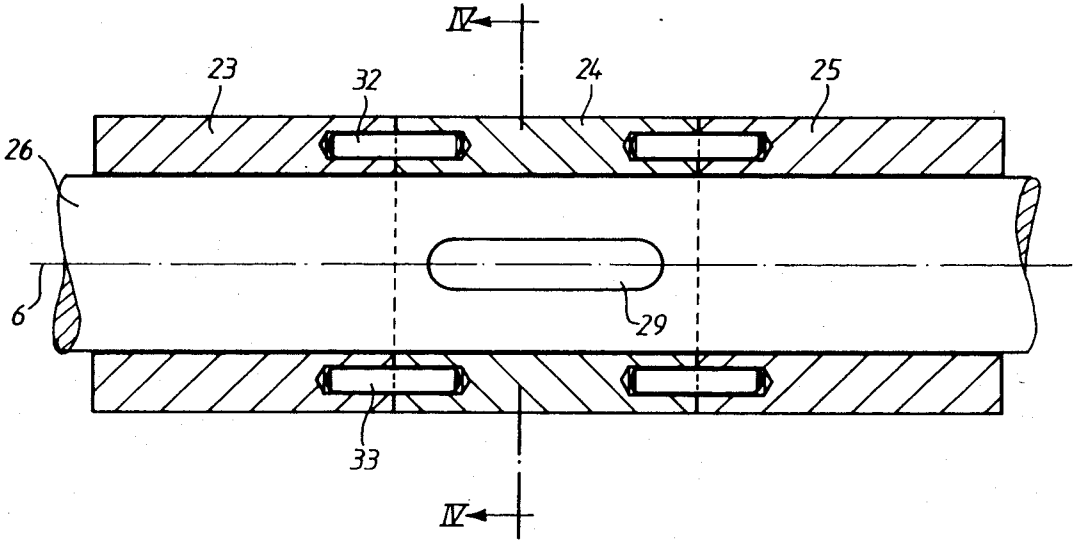
FIG. 3 is an enlarged sectional view of the stirrer shaft with the hubs of the mixing blades.
Figure 4:
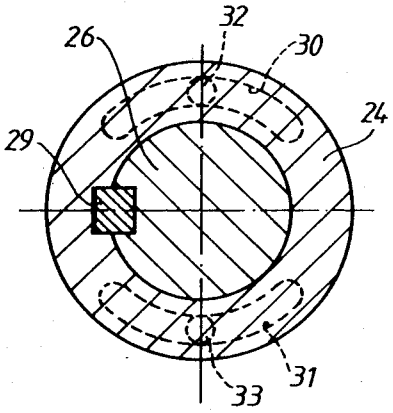
FIG. 4 is a section taken on the line IV—IV of FIG. 3.

As can be seen in detail from FIGS. 3 and 4, the central hub 24 is connected via a key 29 to the stirrer shaft 26 so as to rotate with the latter at all times. By contrast, the hubs 23 and 25 of the two outer groups 10 and 12 of mixing blades are mounted on the stirrer shaft 26 so as to be capable of limited free rotational movement relative thereto. These two hubs 23, 25 have two arcuate, limited lost-motion grooves 30, 31 of predetermined peripheral length and in each of which is accommodated a coupling pin 32, 33 that is fixed to the central hub 24.

As can be seen from FIG. 1, the mixing blades project beyond the lower or open edge 2*a* of the second vessel part 2. Therefore, even when the first vessel part 1 is separated from the second vessel part 2, by lowering of a known lift mechanism 34, to effect movement of the vessel 1 in the horizontal direction after a mixing operation is completed, it normally would be necessary to lower the first vessel part 1 by such a further distance that its upper edge 1*a* lies at a level below that of the radius of the mixing blades. In order to avoid the considerable lowering movement which is necessary for this and the correspondingly necessary large height of the mixing device, provision is made according to the invention for the mixing blades to be capable of movement relative to the vessel part 2 in response to relative horizontal movement of the vessel parts 1 and 2.

The limited rotational mobility of the hubs 23 and 25 with respect to the stirrer shaft 26 which is explained with the aid of FIGS. 3 and 4 serves this purpose. It may be assumed, for instance, that after completion of a mixing operation the vessel part 1 is located in the slightly lowered position shown in FIG. 1. The rotary position of the stirrer shaft is such that the mixing blades of the central group 11 are located at a level at or slightly above the upper edge 1*a* of the vessel part 1. On the other hand, the mixing blades of the two outer groups 10 and 12 project into the vessel part 1.

If the vessel part 1 is moved horizontally on the wagon 4 at right angles to the drawing plane of FIG. 1, then the edge 1*a* of the vessel part 1 will strike the mixing blades of the two outer groups 10 and 12. By appropriate choice of the horizontal direction of movement of the vessel part 1 (at right angles to the drawing plane of FIG. 1) the mixing blades of the groups 10 and 12 and their hubs 23, 25 will be rotated opposite the driven direction of rotation relative to the stirrer shaft 26, which is facilitated by the engagement of the coupling pins 32, 33 in the annular grooves 30, 31 which are of such arcuate length that the mixing blades of the outer groups 10 and 12 may rotate such an extent that the vessel part 1 may pass from beneath the vessel part 2.

Another vessel part 1 with a new charge of material to be mixed can then be freely pushed under the vessel part 2. The vessel part 1 then may be raised slightly by means of the lifting mechanism 34 and sealed to the vessel part 2 by known clamping devices which are not shown. The mixing vessel, consisting of the vessel parts 1 and 2, is then pivoted by the motor 9 by 180° into the mixing position in which the mixing operation is carried out by the stirrer which is driven by the motor 28.

In the mixing position the mixing vessel is upside down from the position shown in FIGS. 1 and 2. That is, the vessel part 1 is uppermost and the part 2 is lowermost.

When the drive motor 28 is switched on the follower pins 32, 33 in the annular grooves 30, 31 of the hubs 23, 25 first of all move relatively (over the peripheral length of the said annular grooves) until they entrain the hubs 23, 25 and with them the two outer groups 10, 12 of mixing blades. After completion of the mixing operation the mixing vessel is pivoted back into the position shown in FIG. 2, whereupon the removal of the vessel part 1 proceeds in the manner described.

In the embodiment described above the vessel parts 1 and 2 form a vessel having a rectangular cross-sectional shape. Instead of this it is of course also possible within the scope of the invention to use mixing vessels having a circular cross-sectional shape. In such a case the second vessel part 2 in vertical section (according to FIG. 1) is not rectangular but circular in shape. The length of the mixing blades is then adapted accordingly, but at least in the region of the central, longest mixing blades it is advantageous for these mixing blades to be capable of limited free rotational movement with respect to the stirrer shaft in order to rotate the long mixing blades automatically upon separation of the two vessel parts so that they no longer engage the first vessel part 1 which is constructed so as to be transportable when the latter is moved away in the horizontal direction below the second vessel part 2.

I claim:

1. A mixer having two cup-like vessel parts adapted for movement into and out of vessel-forming engagement, one of said vessel parts forming a base normally underlying the other vessel part, a stationary support, bearing means mounting the other vessel part for rotation of the vessel parts when in vessel forming engagement through 180° about a horizontal axis between a starting position in which the other vessel part forms an upper cover for said one of said vessel parts and a mixing position in which the one vessel part then forms an upper cover for the other vessel part, a stirrer shaft mounted in the other vessel part, drive means connected to said stirrer shaft, means mounting said stirrer shaft coaxially with said horizontal axis about which the other vessel part is rotatable, and means for restraining said drive means against bodily movement on said stationary support.

2. A mixer according to claim 1 including mixing blades mounted on said stirrer shaft, said blades being of such length as to project into said one vessel part when the vessel parts are in vessel forming engagement, and means mounting at least some of said mixing blades on said shaft for limited free rotational movement relative thereto.

3. A mixer according to claim 2 wherein said means mounting some of the mixing blades for limited free rotational movement on the stirrer shaft each includes a hub provided with an arcuate groove of predetermined peripheral length, and a coupling pin for each such groove having one end accommodated in each respective groove, the other end of each such pin being connected to the stirrer shaft so as to be fixed against rotation.

4. A mixer according to claim 2 wherein a plurality of groups of said mixing blades are evenly distributed over the periphery of the stirrer shaft, means connecting the mixing blades of one group to the stirrer shaft so as to be fixed against rotation, and means mounting the mixing blades of the other groups on the stirrer shaft so as to be capable of limited free rotational movement relative thereto.

5. A mixer comprising cup-like first and second separable parts movable into and out of vessel-forming engagement; a stirrer shaft mounted on one of said parts for rotation about an axis; driving means for rotating said shaft; and means connecting a plurality of mixing blades to said shaft with said blades circumferentially spaced about said axis in axially spaced groups, each of said blades being of such radial length as to project beyond said one of said parts into the other, said connecting means coupling blades of selected groups to said shaft for limited rotation relative to said shaft.

6. A mixer according to claim 5 wherein each of said groups of blades includes a hub in which said shaft is accommodated, means fixing one of said hubs to said shaft for rotation therewith, and lost motion means coupling said one of said hubs and the remainder thereof.

7. A mixer according to claim 6 wherein said lost motion means comprises a pin each of which is fixed at one end to said one of said hubs and has its other end extending into an arcuate groove in another of said hubs.

8. A mixer comprising cup-like first and second separable parts movable into and out of vessel-forming engagement; a stirrer shaft mounted on one of said parts for rotation about an axis; driving means for rotating said shaft; and means connecting a plurality of mixing blades to said shaft with said blades circumferentially spaced about said axis in a number of groups mounted in axial alignment and with the blades of adjacent groups being circumferentially staggered, each of said blades being of such radial length as to project beyond said one of said parts into the other, said connecting means coupling blades of alternate groups in fixed relation to said shaft and blades of each intermediate group to said shaft for limited rotation relative to said shaft.

* * * * *